US009340063B1

(12) United States Patent
Hale

(10) Patent No.: US 9,340,063 B1
(45) Date of Patent: May 17, 2016

(54) HANDHELD ALL-TERRAIN CHALKER

(71) Applicant: Jon Hale, Alpine, CA (US)

(72) Inventor: Jon Hale, Alpine, CA (US)

( * ) Notice: Subject to any disclaimer, the term of this patent is extended or adjusted under 35 U.S.C. 154(b) by 68 days.

(21) Appl. No.: 14/537,074

(22) Filed: Nov. 10, 2014

(51) Int. Cl.
*B43L 13/00* (2006.01)
*B44D 3/38* (2006.01)

(52) U.S. Cl.
CPC ..... *B44D 3/38* (2013.01)

(58) Field of Classification Search
CPC ..... A45D 3/38; B43K 23/016; B44D 3/38
USPC ..... 33/1 G, 32.1, 32.2, 34, 35, 414; 222/174, 608, 611.1, 181.1, 481; 401/88, 89, 90, 92
See application file for complete search history.

(56) References Cited

U.S. PATENT DOCUMENTS 3,843,120 A * 10/1974 Ricci ..... A63D 15/006 222/142.5
4,273,264 A * 6/1981 Legg ..... A01B 69/022 111/33
4,537,331 A * 8/1985 Matula ..... E01C 19/16 222/165
6,044,568 A * 4/2000 Raymond ..... B44D 3/38 33/1 G
6,390,336 B1 * 5/2002 Orozco ..... B05B 15/061 222/162
6,484,412 B1 * 11/2002 Donaldson ..... B44D 3/38 141/364
7,178,695 B1 * 2/2007 Malenfant ..... E01C 23/20 222/166
7,367,515 B1 * 5/2008 Newman ..... E01C 23/22 222/608
2003/0221325 A1 * 12/2003 Dekort ..... B44D 3/38 33/414
2007/0131714 A1 * 6/2007 Jutras ..... B05B 9/007 222/135
2011/0258866 A1 * 10/2011 Mikhaylenko ..... B44D 3/38 33/414
2013/0078025 A1 * 3/2013 Turgeman ..... B41J 2/17513 401/258
2013/0129400 A1 * 5/2013 Hadley ..... B62K 3/002 401/88
2013/0200108 A1 * 8/2013 Di Bono ..... A47L 13/22 222/174
2015/0330039 A1 * 11/2015 Vanneman ..... E01C 23/163 404/94
2016/0052332 A1 * 2/2016 DeLeo ..... B44D 3/38 33/414

* cited by examiner

*Primary Examiner* — G. Bradley Bennett
(74) *Attorney, Agent, or Firm* — Gary L. Eastman, Esq.

(57) ABSTRACT

A Handheld All-Terrain Chalker of the present invention is designed to create straight chalk lines on all types of surfaces. The Handheld All-Terrain Chalker works independent of the surface in which the chalk lines are to be drawn and are unaffected by the variations of the surface. The Handheld All-Terrain Chalker includes a chalk hopper and a removable ergonomic handle. The chalk hopper is a semi-circular bucket having a storage container integrally formed with a dispenser. The storage container has an opening to allow the insertion of chalk. The dispenser is formed with a bottom having circular perforations or slotted openings to allow chalk to be dispensed to draw the chalk lines. To control the amount of chalk being dispensed and the width of the chalk line, a gasket or an adjustable chalk line plate is used to regulate the opening of the dispenser.

20 Claims, 11 Drawing Sheets

HANDHELD ALL-TERRAIN CHALKER

FIELD OF THE INVENTION

The present invention relates generally to chalk dispensers, and more particularly, but not exclusively, to a hand-held chalk dispenser with adjustable chalk widths for drawing chalk lines over all types of terrain.

BACKGROUND OF THE INVENTION

Chalk lines are highly visible straight lines drawn on relatively flat surfaces to allow a user to clearly mark the surface to provide visual cues for distance measurements, to designate borders, or for spatial orientation among others. The temporary nature of chalk allows lines to be drawn without permanently marking the surface and the low-cost of chalk allows the liberal use of chalk to create chalk lines. As a result, chalk lines are important in various industries as well as everyday life for the ability to provide low-cost, temporary markings.

Chalk lines are typically drawn using a handheld chalk line tool for smaller areas or with field chalk markers for larger areas. Handheld chalk line tools draw straight chalk lines by the use of a string coated with chalk. The string is laid across the surface to be marked and pulled taut. The string is then plucked, causing the string to strike the surface which transfers the chalk to the surface along the straight line. As a handheld tool the strings have a very small diameter and short length to allow portability, thereby limiting its use to smaller areas. Additionally, the string of the handheld chalk line tool is susceptible to breakage and to moisture which affects the ability of the string to retain the proper amount of chalk to create a visible line. To overcome the shortfalls of the handheld chalk line tool, larger field chalk markers are used.

The field chalk markers typically include a hopper with a controllable dispenser mounted on a frame with wheels. The hopper is filled with chalk and as a user pushes the field chalk marker along a relatively flat surface, the dispenser dispenses the chalk onto the surface thereby creating a line. In order to adequately apply the chalk to the surface, the dispenser is placed as close as possible to the surface to prevent the chalk from being displaced by external forces such as wind. On uneven surfaces, the limited clearance between the dispenser and the surface becomes a problem as the dispenser may contact the uneven surface making it difficult to move the field chalk marker. Further, the wheels of the field chalk marker contacts and moves along the surface making the field chalk marker susceptible to surface changes. The various angles, heights, depths, and obstructions from an uneven surface, such as a construction zone, will veer the field chalk marker off-course and greatly hinder the field chalk marker from creating straight, visible chalk lines.

In light of the disadvantages of existing chalk line tools and field chalk markers, it would be advantageous to provide a handheld chalk line tool utilizing existing low-cost chalk to create straight lines on all types of terrain. It would be further advantageous to provide a handheld chalk line tool which does not contact the surface. It would be further advantageous to provide a handheld chalk line tool capable of quickly changing the width of the chalk line. It would be further advantageous to provide a handheld chalk line tool having an ergonomic handle positioning the center of gravity along the central axis of the hopper to reduce user fatigue.

SUMMARY OF THE INVENTION

A Handheld All-Terrain Chalker of the present invention is designed to create straight chalk lines on all types of surfaces.

The Handheld All-Terrain Chalker works independent of the surface in which the chalk lines are to be drawn and are unaffected by the variations of the surface. The Handheld All-Terrain Chalker includes a chalk hopper and a removable ergonomic handle. The chalk hopper stores and holds all types of chalk known in the prior art such as marking chalk or casting plaster. The ergonomic handle incorporates an S-shape to position the handle grip along the center of gravity of the Handheld All-Terrain Chalker, providing a better ergonomic grip for reducing user fatigue and chance of injury.

In a preferred embodiment of the Handheld All-Terrain Chalker the chalk hopper is a semi-circular bucket having a storage container integrally formed with a transition ledge which transitions into a dispenser. The storage container has an angled opening with a lip. The dispenser is formed with a chalk line plate having a chalk line pattern where the chalk line pattern is a series of holes formed in the chalk line plate in a staggered pattern. The chalk line plate is further formed with sockets to receive a chalk line gasket. The chalk line gasket is a circular disk with a chalk line opening sized to deliver the correct amount of chalk to create the desired chalk line width. The chalk line opening may be sized smaller than the chalk line pattern on the chalk line plate to control the width of the chalk line. Multiple chalk line gaskets, with each chalk line gasket having a different chalk line opening, may be used interchangeably to provide different width chalk lines.

In an alternative embodiment, the dispenser is formed with a dispenser plate having a dispenser opening having two slotted channels and an adjustable chalk line plate mounting hole. A chalk line plate having multiple chalk line patterns is formed with a quick-release fastener. The quick-release fastener is used to mount the adjustable chalk line plate to the dispenser plate by inserting the fastener into the adjustable chalk line plate mounting hole. The dispenser opening is sized to fully accommodate the multiple chalk line patterns of the adjustable chalk line plate. The chalk line patterns of the adjustable chalk line plate regulate the width of the chalk line and the amount of chalk dispensed. By switching between the chalk line patterns on the adjustable chalk line plate, multiple different chalk lines may be drawn using the same Handheld All-Terrain Chalker.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF THE INVENTION

Figure 1:
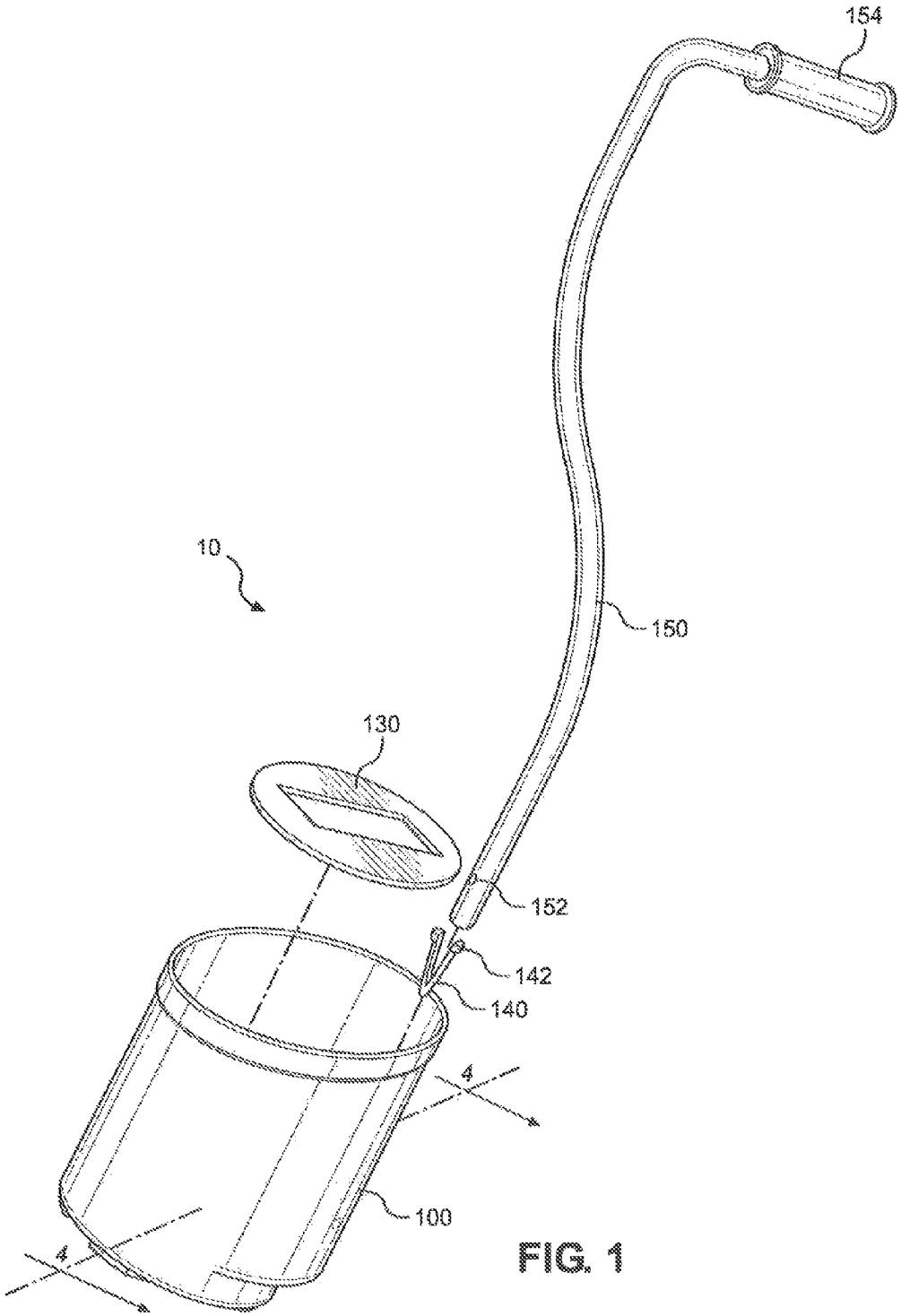
FIG. 1 is an exploded view of the preferred embodiment of the Handheld All-Terrain Chalker of the present invention showing the removable ergonomic handle, retaining clip, chalk line gasket, and chalk hopper.
Figure 2:
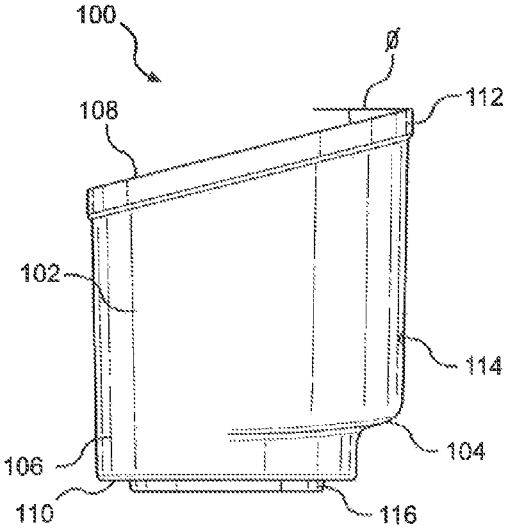
FIG. 2 is a side view of the chalk hopper.
Figure 3:
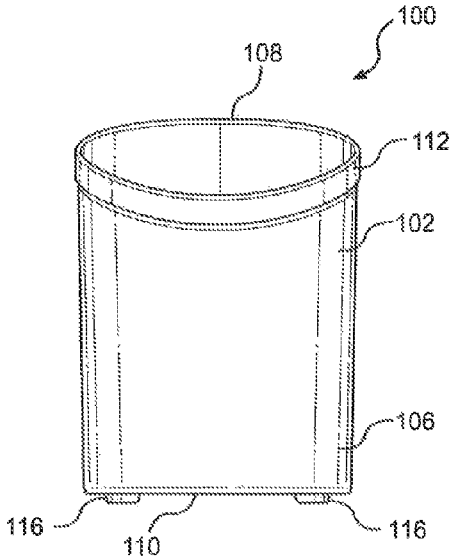
FIG. 3 is a front view of the chalk hopper.
Figure 4:
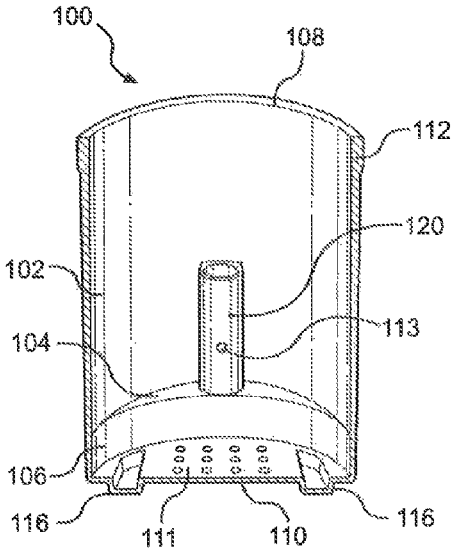
FIG. 4 is a cross-sectional view of the chalk hopper taken along line 4-4 of FIG. 1.
Figure 5:
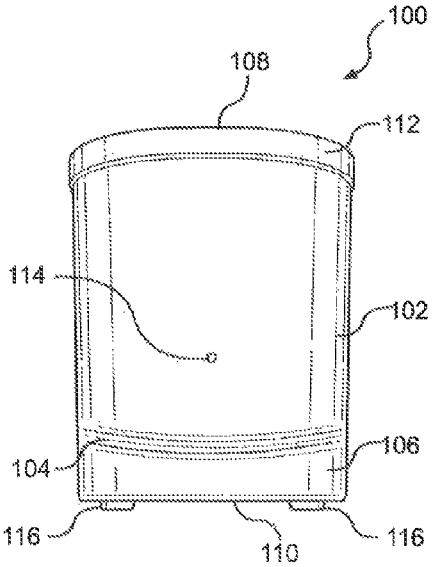
FIG. 5 is a back view of the chalk hopper.
Figure 6:
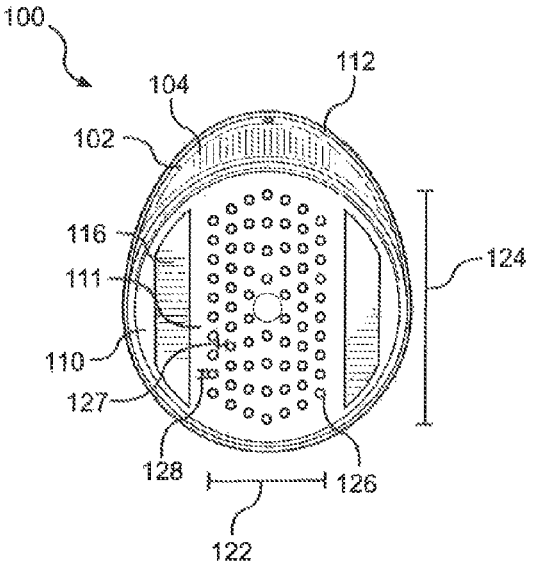
FIG. 6 is a bottom view of the chalk hopper.
Figure 7:
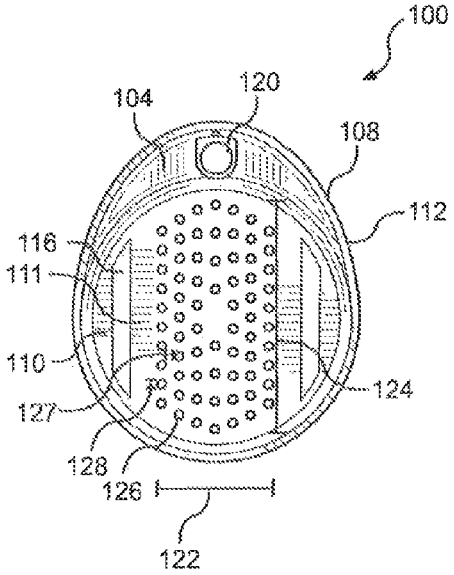
FIG. 7 is a top view of the chalk hopper.

Referring initially to FIG. 1, an exploded view of the Handheld All-Terrain Chalker of the present invention is shown and generally designated 10. The Chalker 10 includes a chalk hopper 100, a chalk line gasket 130, a retaining clip 140, and an ergonomic handle 150.

The chalk hopper 100, described in conjunction with FIGS. 3-7, is a semi-circular bucket having a storage container 102 integrally formed with a transition ledge 104 which transitions into a dispenser 106. The storage container 102 has an opening edge 108 created at an angle (1). A lip 112 is formed on the exterior of the storage container 102 adjacent the opening edge 108 to provide additional material for additional structural strength and rigidity to prevent the opening edge 108 from flexing. The walls of the storage container 102 extend downward in a linear line from the opening edge 108, wherein a portion of the wall transitions into the transition ledge 104 and the remaining portion of the wall transitions into the dispenser 106. The transition ledge 104 slopes at a slight angle and transitions into the dispenser 106, forming the final walls of the dispenser 106.

The storage container 102 has a larger volume than the dispenser 106 and a larger projected area. The slight angle of the transition ledge 104 funnels the chalk in the storage container 102 into the integrally formed dispenser 106. The larger volume of the storage container 102 allows the chalk hopper 100 to store large amounts of chalk for the dispenser 106 to dispense and the transition ledge 104 ensures all of the chalk held in the storage container 102 funnels into the dispenser 106, thereby allowing the Handheld All-Terrain Chalker 10 to draw longer and wider lines.

At the edge of the dispenser 106, opposite the transition ledge 104, the dispenser 106 is formed with a chalk line plate 110. The chalk line plate 110 is a circular plate formed with a chalk line pattern 111 and multiple sockets 116. The chalk line pattern 111 are holes 126 formed into the chalk line plate 110 and arranged in a particular staggered pattern confined within a semi-rectangular perimeter having a width 122 and a length 124. In the preferred embodiment the holes 126 are circles with a diameter 128. It is contemplated that the holes 126 may be squares, diamonds, rectangles, or other shapes and that the use of circles is not meant to be limiting. The hole 126 and its corresponding area regulates the amount of chalk each hole 126 outputs. To increase the amount of chalk dispensed, each hole 126 may be increased in size. To decrease the amount of chalk dispensed, each hole 126 may be decreased in size.

Along the width 122 of the chalk line pattern 111, each hole 126 is separated by a distance 127, where the width 122 of the chalk line pattern 111 is the sum of the diameters 128 of the holes 124 and the distance 127 between each hole 126. Thus, by changing the diameter 128 of the holes 126 and distance 127 between each hole 126, the overall number of holes 26 along the width 122 of the chalk line pattern 111 can be adjusted.

In the preferred embodiment of the Handheld All-Terrain Chalker 10, the chalk line pattern 111 has a total of seventy (70) holes 126 with a diameter 128 of ⅛ inch where the width 122 of the chalk line pattern 111 includes seven (7) holes 126. The chalk line pattern 111 arranges the holes 126 in a staggered pattern. By utilizing ⅛ inch diameter holes 126 the chalk, such as marking chalk and casting plaster as known in the art, placed within the chalk hopper 100 will not discharged under its own weight. This allows the precise control of the discharge rate of the chalk in the chalk hopper 100 to create chalk lines. The staggered pattern, distance 127 spacing, and diameter 128 of the holes 126 of the chalk line pattern 111 creates a defined and clearly visible chalk line by overlapping the delivered chalk from each hole 126 with one another, thereby ensuring the individual holes 126 do not result in a diffused or blurry chalk line.

It is contemplated that the use of ⅛ holes is not meant to be limiting. It may be desirable in certain applications to allow chalk within the chalk hopper 100 to continuously flow out of the chalk hopper 100 thereby using a different diameter hole 126. The use of different diameter holes 126 is contemplated and may be adjusted for different chalk types, different discharge rates, and various other parameters.

The socket 116 is a hollow protrusion extending from the chalk line plate 110, creating a hollow cavity on one side of the chalk line plate 110 and a raised section on the opposite side of the chalk line plate 110. As shown, two sockets 116 are formed into the chalk line plate 110. Each socket 116 is located on either side of the chalk line pattern 111. The number and placement of sockets 116 is not meant to be limiting and it is contemplated that any number of sockets 116 with varying placements may be formed in the chalk line plate 110. The raised section of the socket 116 provides clearance between the section of the chalk line plate 110 formed with the chalk line pattern 111 and a surface, such as a construction floor or athletic field. The clearance provides space for the chalk line pattern 111 to dispense an adequate amount of chalk to visibly mark the drawing surface. This allows a user to tap the chalk hopper 100 on the floor and dispense the chalk through the dispenser 106 to create temporary, visible chalks lines.

Integrally formed within the storage container 102 of the chalk hopper 100 is a handle receiver 120. The handle receiver 120 is a tubular tube formed along the inner wall of the storage container 102, extending from the transition ledge 104 up a predetermined distance. The handle receiver 120 is dimensioned to receive the ergonomic handle 150. Further formed in the handle receiver 120 is a handle retaining hole 113 which aligns with a handle retaining hole 114 formed in the storage container 102 in a straight line.

The handle retaining holes 113 and 114 are sized to receive the retaining clip 140 shown in FIG. 1. The retaining clip 140 has two buttons 142 and is inserted into the ergonomic handle 150, where the buttons 142 protrude through the retaining clip holes 152. As the ergonomic handle 150 is passed through the handle receiver 120, the retaining clip 140 compress and pushes the buttons 142 flush with the surface of the ergonomic handle 150 allowing the ergonomic handle 150 to be inserted. Once the buttons 142 reach the handle retaining holes 113 and 114, the retaining clip 140 decompresses and the buttons 142 pass through the handle retaining holes 113 and 114 providing an obstruction to prevent the ergonomic handle 150 from being disengaged from the handle receiver 120.

In the preferred embodiment, the chalk hopper 100 is created through injection molding. The material used may be polypropylene, polyethylene or various other materials with similar physical characteristics used for the injection molding process. The injection molding process produces the chalk hopper 100 having the storage container 102, the transition ledge 104, the dispenser 106, the chalk line plate 110, and the handle receiver 120 as a single unit. Alternatively, the storage container 102, the transition ledge 104, the dispenser 106, the chalk line plate 110, and the handle receiver 120 may be separately formed and subsequently attached together to produce the chalk hopper 100. The method and process of producing the chalk hopper 100 as described is not meant to be limiting and various other methods and processes used to produce the chalk hopper 100 is contemplated without departing from the spirit and scope of the invention.

Figure 8:
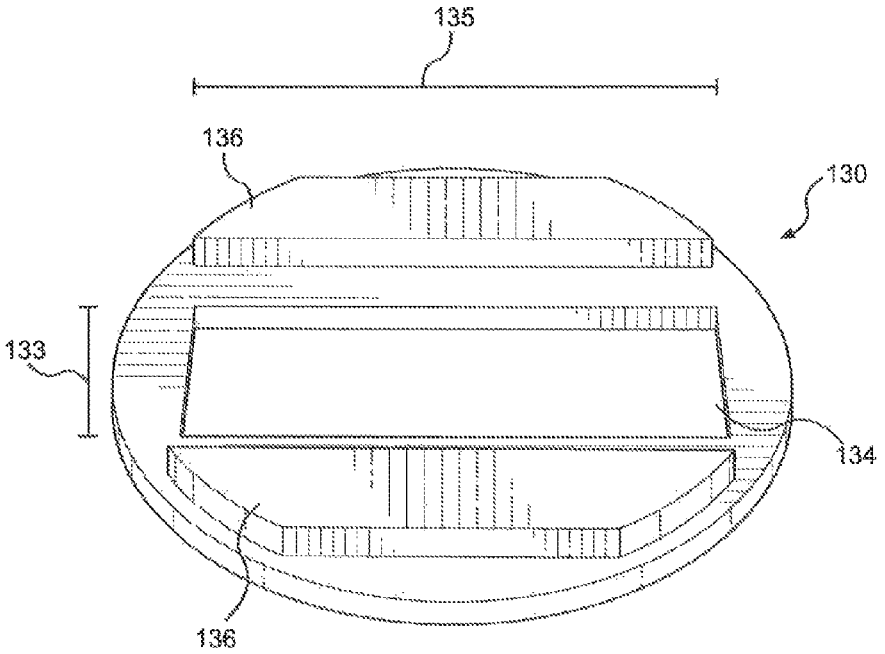
FIG. 8 is a bottom perspective view of the chalk line gasket.

Referring now to FIG. 8, a bottom perspective view of the chalk line gasket 130 is shown. The chalk line gasket 130 is a circle gasket formed with a chalk line opening 134 in the center and formed on either side of the chalk line opening 134 are protrusions 136 dimensioned to fit within the socket 116 of the chalk line plate 110. The protrusions 136 of the chalk line gasket 130 fit securely within the socket 116 of the chalk line plate 110 to prevent the gasket 130 from being displaced. The chalk line gasket 130 is dimensioned to completely cover the chalk line plate 110 including the chalk line pattern 111 and its holes 126. By placing the gasket 130 over the chalk line plate 110, it obstructs the holes 126 of the chalk line pattern 111 preventing any chalk from passing through the holes 126. The chalk line opening 134 is formed in the chalk line gasket 130 to provide access to the chalk line pattern 111 and its holes 126 when the chalk line gasket 130 is placed over the chalk line plate.

When the chalk line gasket 130 is placed over the chalk line plate 110, the dimensions of the chalk line opening 134, not the width 122 of the chalk line pattern 111, dictates the width of the chalk line. In the preferred embodiment, the chalk line opening 134 is rectangle with a width 133 and length 135. By dimensioning the width 133 of the chalk line opening 134 narrower than the width 122 of the chalk line pattern 111, a narrower chalk line width is created as portions of the chalk line gasket 134 covers portions of the chalk line pattern 111 preventing the chalk from passing through the obstructed holes 126. The chalk line gasket 130 may be made of a softer material compared to the chalk hopper 100 such as a medium durometer polymer. Using a softer material allows the chalk line gasket 130 to be deformed for easier insertion and removal from the interior of the chalk hopper 100 when compared to a harder material. However, it is contemplated that a harder material may be used to from the chalk line gasket 130. By changing between various chalk line gaskets 130 having varying widths 133 and lengths 135, the width of the chalk line may be quickly changed. The chalk line opening 134 may be as narrow as a single hole 126 diameter 128 or as wide as the width 122 of the chalk line pattern 111.

Figure 9:
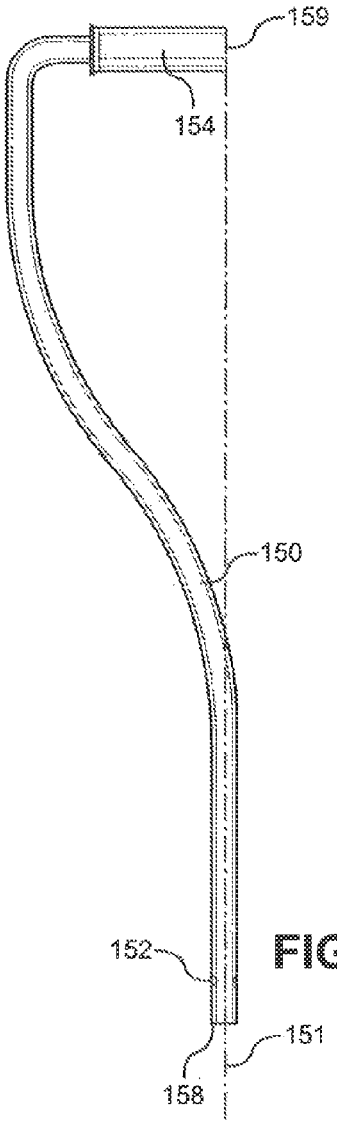
FIG. 9 is a side view of the ergonomic handle.
Figure 10:
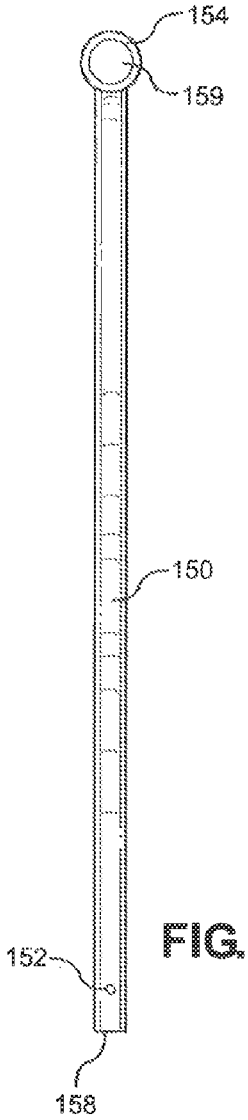
FIG. 10 is a back view of the ergonomic handle.
Figure 11:
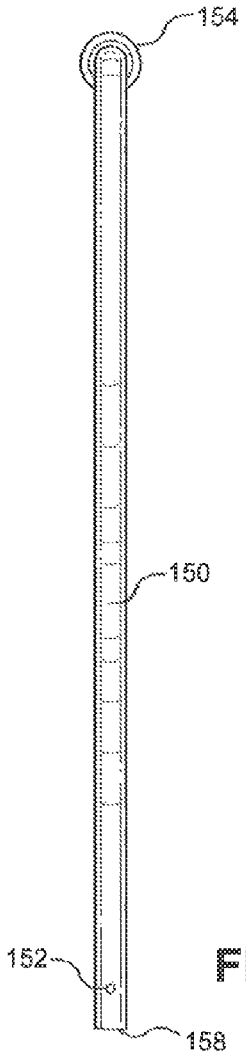
FIG. 11 is a front view of the ergonomic handle.

As shown in FIGS. 9-11 the ergonomic handle 150 is a metal tube having a first end 158 and a second end 159, a handle grip 154 attached at the second end 159 of the ergonomic handle 150 and retaining clip holes 152 formed on the ergonomic handle 150 adjacent the first end 158. The ergonomic handle 150 is formed with an S-shaped curve where the first end 158 of the ergonomic handle 150 is substantially vertical which then curves in an S-shape towards the second end 159 which is oriented substantially perpendicular to the first end 158. The second end 159 of the ergonomic handle 150 terminates at an axial line 151 projected through the center of the first end 158 of the ergonomic handle 150. This places the handle grip 154 along the center of gravity 160 (shown in FIG. 14) of the Handheld All-Terrain Chalker 10. Placing the hand grip 154 along the center of gravity 160 eliminates a moment arm at the fulcrum of the Handheld All-Terrain Chalker 10 when the hand grip 154 is held by a user. This prevents rotational and twisting forces when the Handheld All-Terrain Chalker 10 is moved substantially vertically up and down in direction 162 (shown in FIG. 15). By minimizing and/or eliminating the occurrence of rotational and twisting force, less force and energy is required to operate the Handheld All-Terrain Chalker 10 thereby reducing fatigue and chance of injury.

Figure 12:
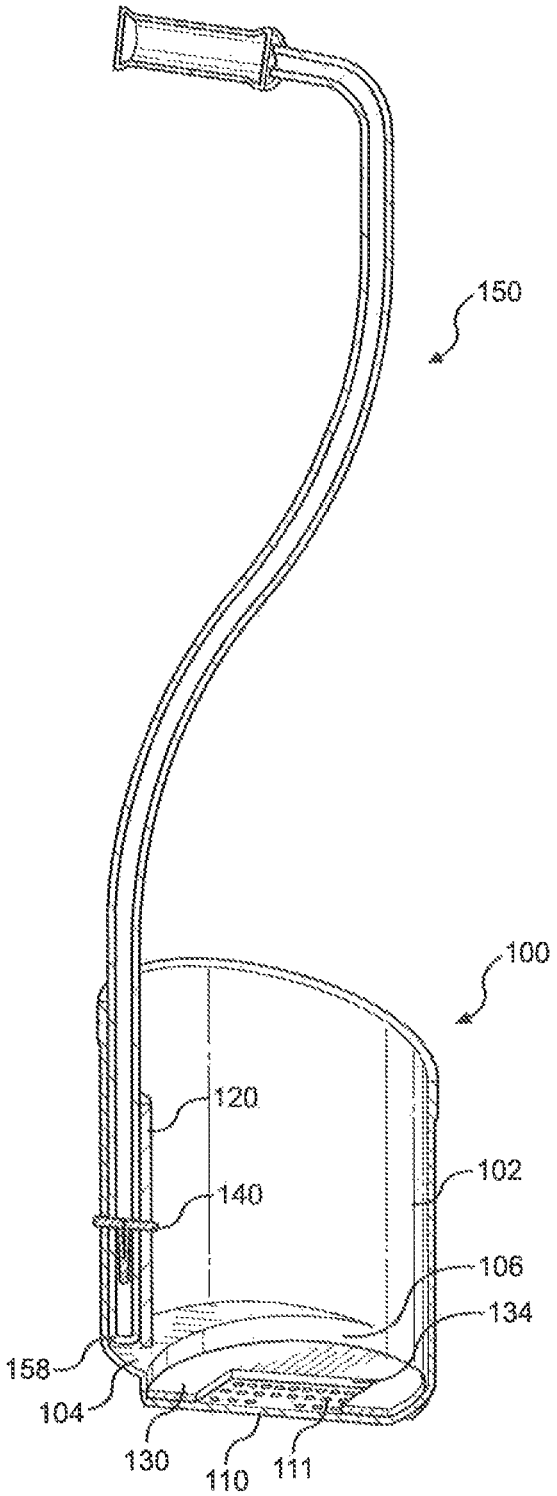
FIG. 12 is a cross-sectional view of a fully assembled Handheld AH Terrain Chalker with a chalk line gasket inserted into the chalk hopper.
Figure 13:
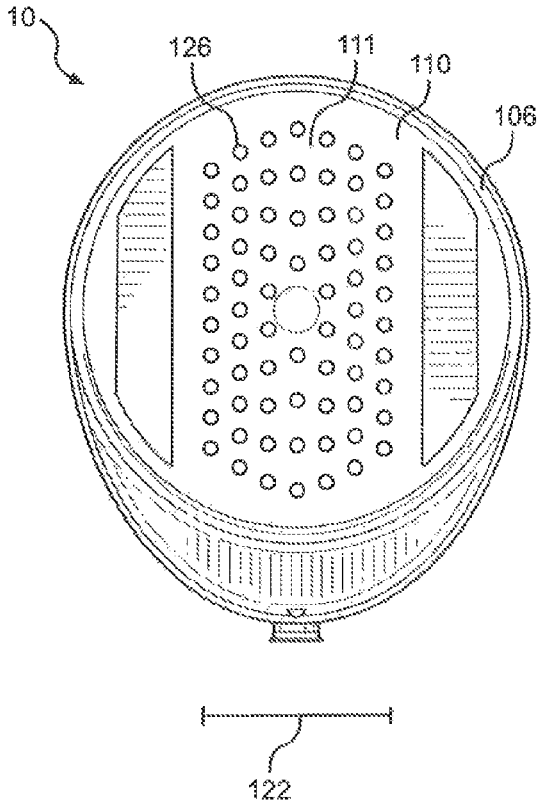
FIG. 13 is a bottom view of the Handheld All-Terrain Chalker configured without a chalk line gasket to create a chalk line with a wide width.
Figure 14:
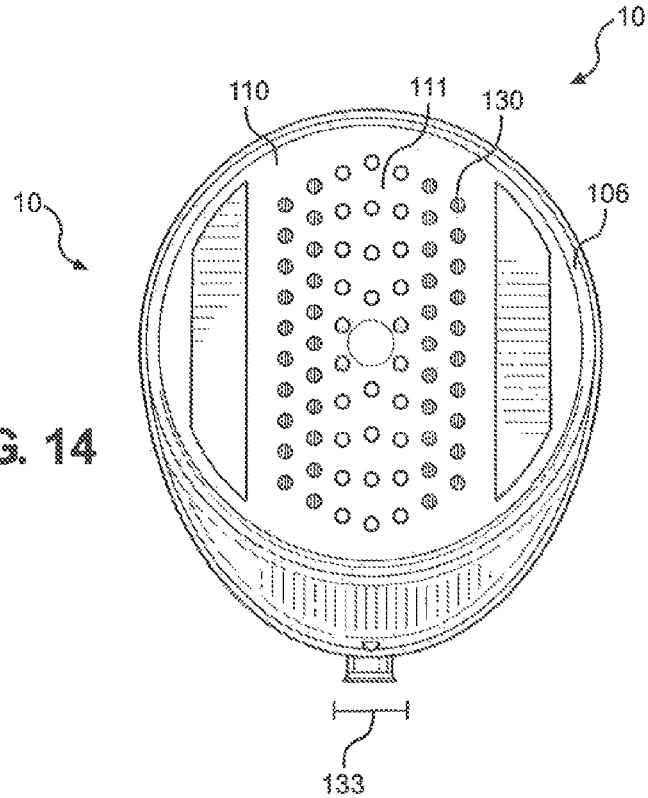
FIG. 14 is a bottom view of the Handheld All-Terrain Chalker configured to create a chalk line with a narrow width by inserting a chalk line gasket into the chalk hopper dispenser.

Referring now to FIG. 12, a cross-sectional view of the Handheld All-Terrain Chalker 10 is shown. As shown, the interior space of the storage container 102 and the dispenser 106 make up the interior space of the chalk hopper 100, whereas the was of the container 102, the transition ledge 104, and the dispenser 106 make up the walls of the chalk hopper 100. As shown, the chalk line gasket 130 is inserted into dispenser 106 and covers the chalk line plate 110. The chalk line opening 134 exposes the chalk line pattern 111 of the chalk line plate 110 to the interior space of the chalk hopper 100. As shown in FIG. 13, a chalk line gasket 130 is not inserted over the chalk line plate 110 of the dispenser 106 of the Handheld All-Terrain Chalker 10 allowing the full use of the chalk line pattern 111 and its holes 126 to draw a chalk line having width 122. In FIG. 14, the chalk line gasket 130 is inserted over the chalk line plate 110 of the dispenser 106 of the Handheld All-Terrain Chalker 10 and covers up the four outer columns of holes 126 allowing the use of only a section of the chalk line pattern 111 to draw a narrower chalk line having width 133 of the chalk line gasket 130.

Referring back to FIG. 12, the ergonomic handle 150 is inserted into the handle receiver 120 of the chalk hopper 100 until the first end 158 of the ergonomic handle abuts the transition ledge 140 wherein the ergonomic handle 150 locks into place. Retaining clip 140 prevents the ergonomic handle 150 from being disengaged from the handle receiver 120.

Figure 15:
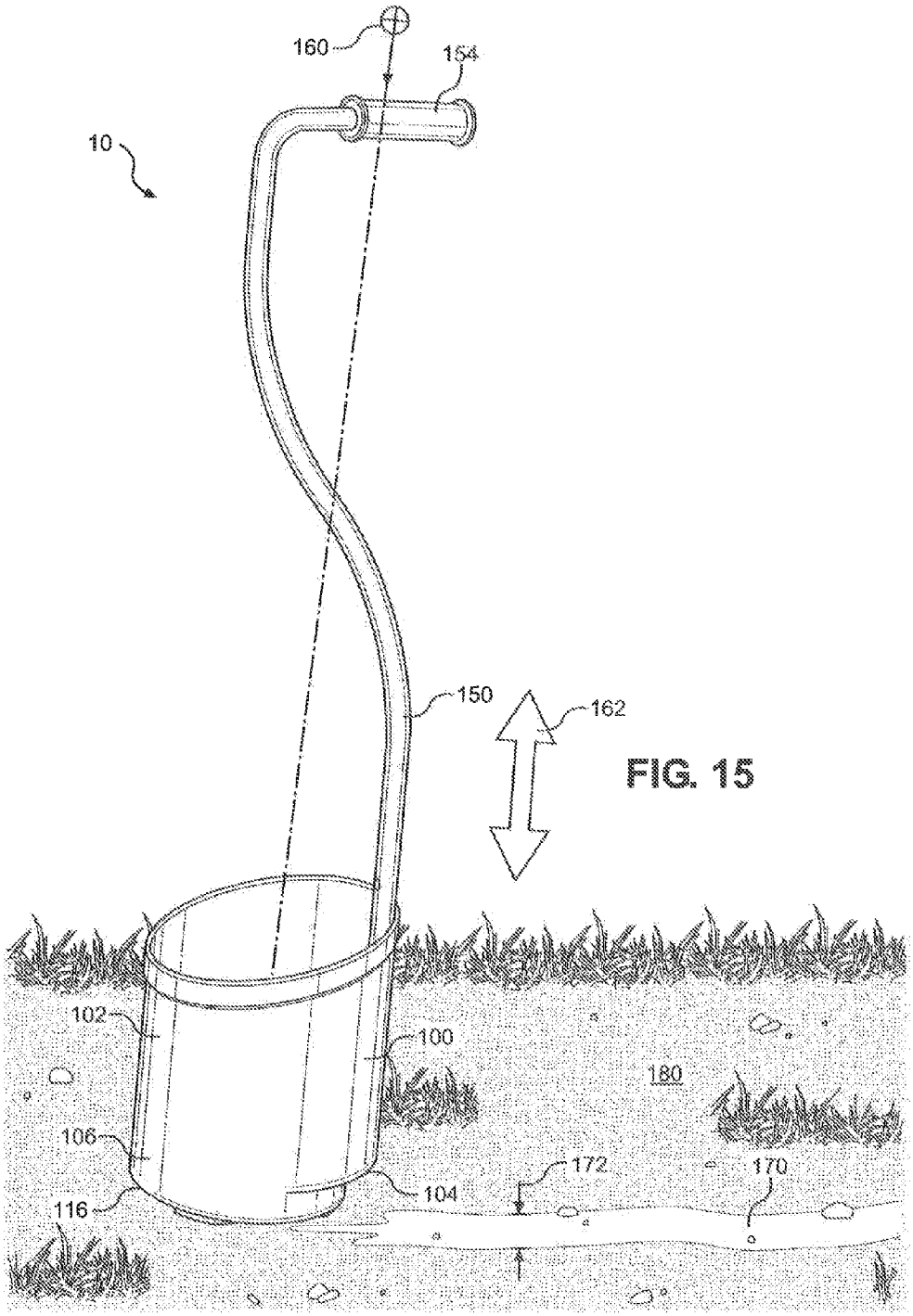
FIG. 15 is a perspective view of the Handheld All-Terrain Chalker of the present invention being used to draw a straight chalk line on an uneven surface.

Referring now to FIG. 15, the Handheld All-Terrain Chalker 10 dispenses the chalk held within the chalk hopper 100 by forcing the chalk within the storage container 102 out through the chalk line plate 110 of the dispenser 106. This is accomplished by the cyclical up and down motion of the Handheld All-Terrain Chalker 10 in direction 162. As the Handheld All-Terrain Chalker 10 is cyclically moved up and down in direction 162, the momentum of the chalk carries the chalk through the holes 126 of the chalk line pattern 111 of dispenser 106. Moving the Handheld All-Terrain Chalker 10 downwards creates a downward momentum on the chalk. As the Handheld All-Terrain Chalker 10 comes to a complete stop the forward momentum and motion of the chalker is also stopped.

The holes 126 in the dispenser 106 allow the momentum of the chalk directly above the holes 126 to carry itself out through the holes 126. The momentum of the chalk not within the holes 126 is stopped by the dispenser 106. As the chalk within the hole 126 dispenses, the volume once occupied by the dispensed chalk is replaced by the chalk in the storage container 102. As the chalk exits the dispenser 106, it coats an area. To create a chalk line 170 on an uneven surface 180, the Handheld All-Terrain Chalker 10 is cyclically pulsated up and down along a straight line, connecting the previous area of chalk with subsequent areas of chalk thereby creating the chalk line 170 having a width 172. To increase the density of the chalk line 170 for greater visibility additional chalk may be deposited in a single area. As a result, the rate of the cyclical up and down movement close to the surface will affect the density of the intended line as well as the pace of travel while dispensing the chalk.

The width 172 of the chalk line 170 is controlled by the width of the dispensed chalk from the Handheld All-Terrain Chalker 10. By either inserting or removing the chalk line gasket 130 into the dispenser 106, the width 172 of the chalk line 170 may be either the width 122 of the chalk line pattern 111 or the width 133 of the chalk fine gasket 130. Additionally, different chalk line gaskets 130 having different chalk line patterns 111 may be interchanged for a variety of different chalk line widths 172.

As shown in FIG. 15, the Handheld All-Terrain Chalker 10 is unaffected by the uneven surface 180. The Handheld All-Terrain Chalker 10 is used independent of the uneven surface 180 and does not rely on an even surface to dispense chalk in a straight line. The Handheld All-Terrain Chalker 10 is operated by hand and the user may alter the positioning of the Handheld All-Terrain Chalker 10 to adapt to the uneven surface to draw a clearly defined straight chalk line 170.

Figure 16:
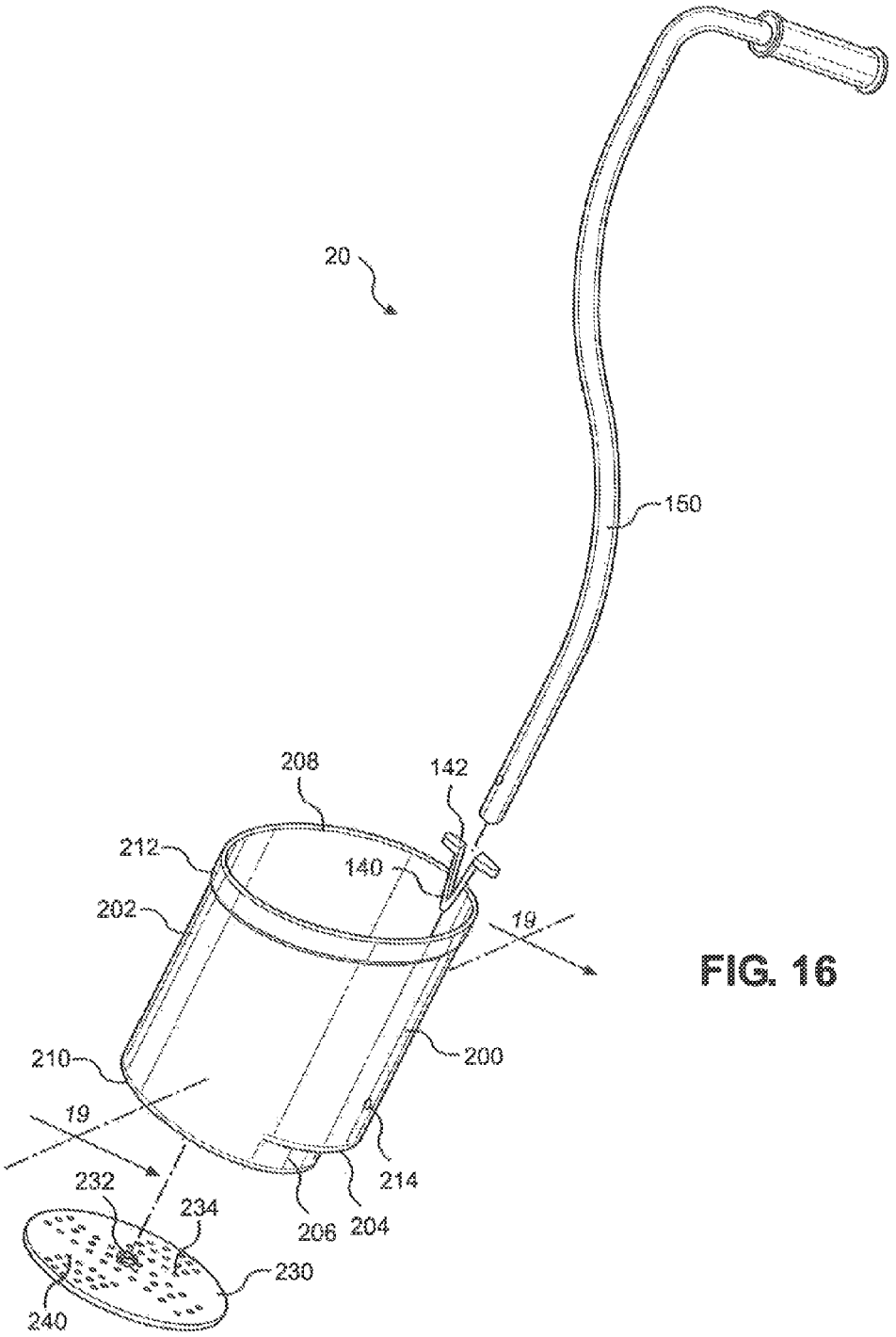
FIG. 16 is an exploded view of an alternative embodiment of the Handheld All-Terrain Chalker having an ergonomic handle, retaining clip, chalk hopper, and adjustable chalk line plate.
Figure 17:
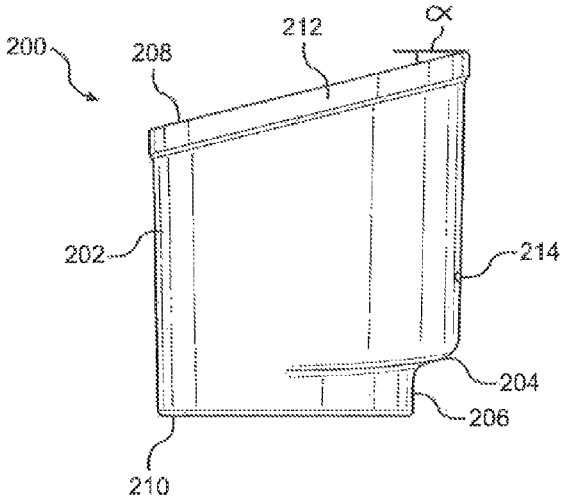
FIG. 17 is a side view of an alternative embodiment of the chalk hopper of the present invention.
Figure 18:
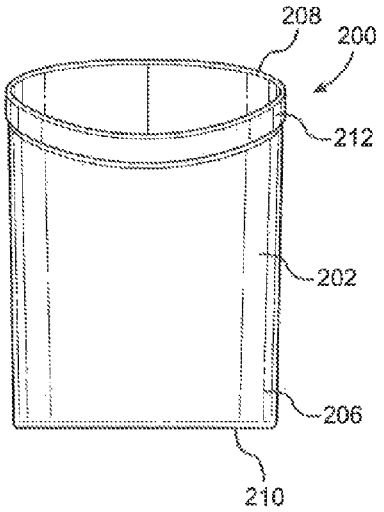
FIG. 18 is a front view of the chalk hopper.
Figure 19:
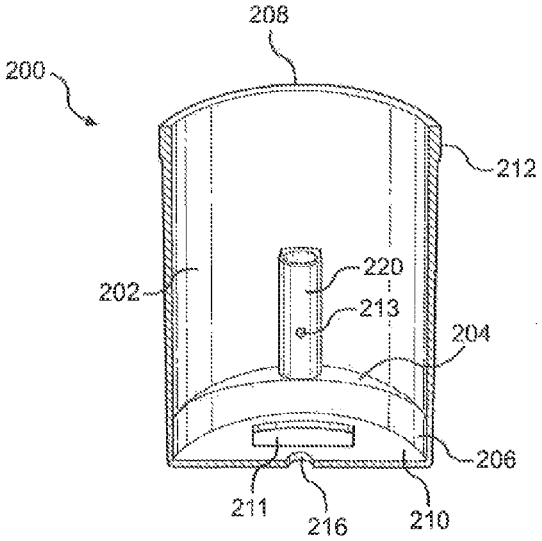
FIG. 19 is a cross-sectional view of the chalk hopper taken along line 19-19 of FIG. 16.
Figure 20:
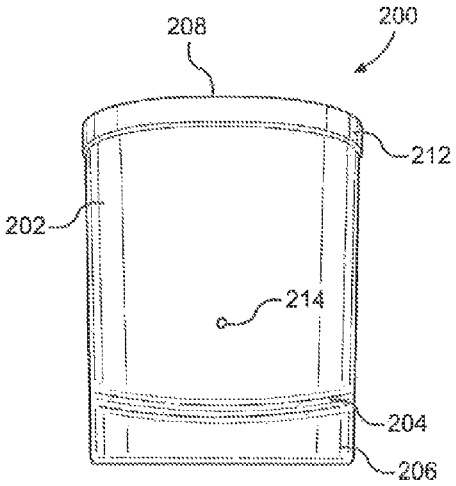
FIG. 20 is a back view of the chalk hopper.
Figure 21:
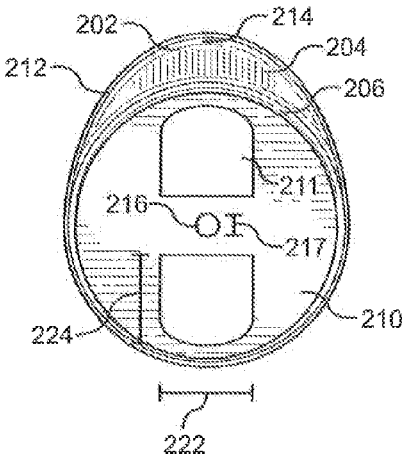
FIG. 21 is a bottom view of the chalk hopper.
Figure 22:
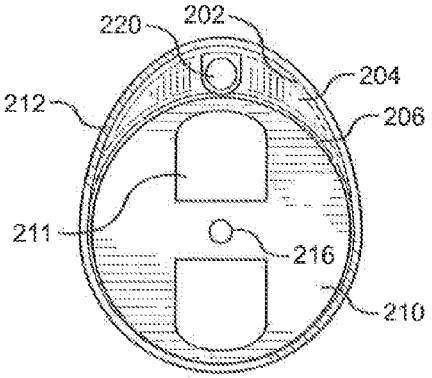
FIG. 22 is a top view of the chalk hopper.

Referring now to FIG. 16 an exploded view of an alternative embodiment of the Handheld All-Terrain Chalker of the present invention is shown and generally designated 20. The Handheld All-Terrain Chalker 20 utilizes the same ergonomic handle 150 and retaining clip 140 as described above where like numerals designate like parts, the descriptions in which are fully incorporated herein. The Handheld All-Terrain Chalker 20 further includes an alternative embodiment of the chalk hopper of the present invention and is generally designated 200.

The chalk hopper 200, described in conjunction with FIGS. 17-22, is a semi-circular bucket formed with a storage container 202 integrally formed with a transition ledge 204 which transitions into a dispenser 206 similar to chalk hopper 100. The storage container 202 has a larger volume and projected area than the dispenser 206. The transition ledge 204 is formed at a slight angle to funnel the chalk in the storage container 202 into the integrally formed dispenser 206. The larger volume of the storage container 202 allows the chalk hopper 200 to store large amounts of chalks for the dispenser 206 to dispense while the transition ledge 204 ensures all of the chalk held in the storage container 202 is funneled into the dispenser 206, allowing the Handheld All-Terrain Chalker 20 to draw longer and wider lines.

The storage container 202 has an opening edge 208 created at an angle α. A hp 212 is formed on the exterior of the storage container 202 adjacent the opening edge 208. The lip 212 provides additional material at the opening edge 208 for additional structural strength and rigidity to prevent the opening edge 208 from flexing. The walls of the storage container 202 extend in a linear line downward from the opening edge 208, where a portion of the wall transitions into the transition ledge 204 and the remaining portion of the wall transitions into the dispenser 206. The transition ledge 204 slopes at a slight angle and transitions into the dispenser 206, forming the final walls of dispenser 206. At the edge of the dispenser 206, opposite the transition ledge 204, the dispenser 206 is formed with a dispenser plate 210. The dispenser plate 210 is a circular plate formed with a dispenser opening 211 and a mounting point 216. The dispenser opening 211 of the dispenser plate 210 includes two semi-rectangular openings with width 222 and length 224.

Integrally formed within the storage container 202 of the chalk hopper 200 is a handle receiver 220. The handle receiver 220 is a tubular tube formed along the inner wall of the storage container 202, extending from the transition ledge 204 up a predetermined distance. The handle receiver 220 is dimensioned to receive the ergonomic handle 150. Further formed in the handle receiver 220 is a handle retaining hole 213 which aligns with a handle retaining hole 214 formed in the storage container 202 in a straight line. The retaining holes 213 and 214 are sized to receive the buttons 142 of the retaining clip 140. As the buttons 142 pass through the retaining holes 213 and 214, the buttons 142 provide an obstruction to keep the ergonomic handle 150 held within the handle receiver 220.

In the preferred embodiment, the chalk hopper 200 is created through injection molding. The material used may be polypropylene, polyethylene or various other materials with similar physical characteristics used in the injection molding process. The injection molding process produces the chalk hopper 200 having the storage container 202, the transition ledge 204, the dispenser 206, the dispenser plate 210, and the handle receiver 220 as a single unit. Alternatively, the storage container 202, the transition ledge 204, the dispenser 206, the dispenser plate 210, and the handle receiver 220 may be separately formed and subsequently attached to produce the chalk hopper 200. The method and process of producing the chalk hopper 100 as described is not meant to be limiting and various other methods and processes used to produce the chalk hopper 200 is contemplated.

Figure 23:
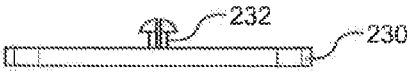
FIG. 23 is a side view of the adjustable chalk line plate.
Figure 24:
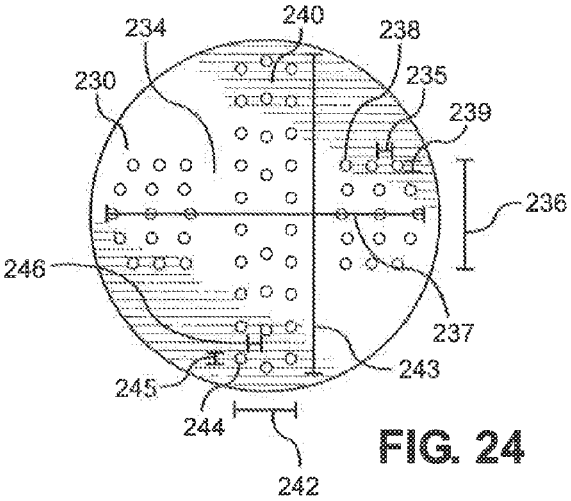
FIG. 24 is a bottom view of the adjustable chalk line plate with a first chalk line pattern and a second chalk line pattern, the first chalk line pattern having a wider width than the second chalk line pattern.
Figure 25:
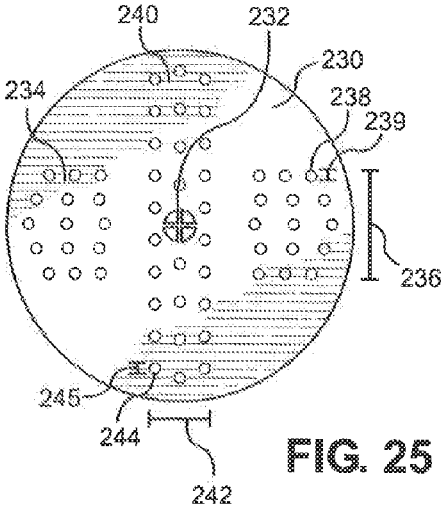
FIG. 25 is a top view of the adjustable chalk line plate.

Referring now to FIG. 23, in conjunction with FIGS. 24 and 25, the adjustable chalk line plate 230 is a circular disk with a quick-release fastener 232 formed into the center of the disk. The adjustable chalk line plate 230 is further formed with a first chalk line pattern 234 and a second chalk line pattern 240. The first chalk line pattern 234 and the second chalk line pattern 240 have a rectangular perimeter and intersect one another at the midpoint at right angles, forming a cross-like pattern on adjustable chalk line plate 230. The adjustable chalk line plate 230 is made of the same or similar material as the chalk hopper 200.

The quick-release fastener 232 includes four prongs, with each prong having a lip. In an uncompressed state, the lips of the prongs have a first diameter. When the prongs are compressed together the lips form a second, smaller diameter to enable the fastener to slip through the mounting point 216 of the dispenser plate 210 with a smaller diameter than the first diameter. Once the prongs are decompressed the lips expand to its original first diameter, locking the quick-release fastener 232 in the mounting point 216 of the dispenser plate 210. The expansion of the quick-release fastener 232 creates adequate friction to prevent the plate from spinning freely, however a minimal amount of force may be used to spin the adjustable chalk line plate 230 from the first pattern 234 to the second pattern 240. The adjustable chalk line plate 230 may be removed from the dispenser plate 210 by compressing and pushing the quick-release fastener 232 out of the mount point 216. It is contemplated that other types of fasteners may be used to mount the adjustable chalk line plate 230 to the dispenser plate 210 while allowing rotation of the adjustable chalk line plate 230 such as rivets, a nut and bolt, screws, or other various types of fasteners without departing from the spirit and scope of the invention.

The first chalk line pattern 234 and the second chalk line pattern 240 are each a pattern of multiple holes formed into the adjustable chalk line plate 230 arranged in particular staggered pattern and confined within a rectangular perimeter having a width and length. The first chalk line pattern 234 are holes 238 formed into the adjustable chalk line plate 230 and arranged in a particular staggered pattern with an exterior perimeter of a rectangle having a width 236 and a length 237. In the preferred embodiment the holes 238 are circles with a diameter 239, however it is contemplated that the holes 238 may be squares, diamonds, rectangles, or various other shapes. The hole 238 and its corresponding area, regulates the amount of chalk each hole 238 dispenses. To increase the amount of chalk dispensed, each hole 238 may be increased in size. To decrease the amount of chalk dispensed, each hole 238 may be decreased in size. Along the width 236 of the chalk line pattern, each hole 238 is separated by a distance 235, where the width 236 of the first chalk line pattern 234 is the sum of the diameters 239 of the holes 238 and the distance 235 between each hole 238. Thus, by changing the diameter 239 of the holes 238 and distance 238 between each hole 238, the overall number of holes along the width 236 of the chalk line pattern 234 can be adjusted.

The second chalk line pattern 240 has a pattern substantially similar to first chalk line pattern 234. The second chalk line pattern 240 are holes 244 formed into the adjustable chalk line plate 230 and arranged in a particular staggered pattern with an exterior perimeter of a rectangle having a width 242 and a length 243. In the preferred embodiment the holes 244 are circles with a diameter 245. Along the width 242 of the second chalk line pattern 240, each hole 244 is separated by a distance 246, where the overall width 242 of the second chalk line pattern 240 is the sum of the diameters 245 of the holes 244 and the distance 246 between each hole 244. The width 242 of the second chalk line pattern 240 is narrower than the width 236 of the first chalk line pattern 234.

The first chalk line pattern 234 and the second chalk line pattern 240 intersect at a right angle and form a cross-shaped pattern. Due to the intersection, the first chalk line pattern 234 and the second chalk line pattern 240 share their respective ten (10) center holes. As a result, the ten (10) center holes are used when the chalk hopper 200 is configured for the first chalk line pattern 234 and the second chalk line pattern 240.

In the preferred embodiment, the first chalk line pattern 234 has a total of forty-one (41) holes 238 with diameter 239 of ⅛ inch. The width 236 of the chalk line pattern 234 includes five (5) holes 238 spaced apart the distance 235. The second chalk line pattern 240 has a total of twenty-eight (28) holes 244 with diameter 246 of ⅛ inch. The width 242 of the second chalk line pattern 240 includes three (3) holes 244 spaced apart the distance 246. In both the first chalk line pattern 234 and second chalk line pattern 240, a staggered pattern is used. By utilizing ⅛ inch diameter holes 238 and 244 respectively, the chalk placed within the chalk hopper 200 will not discharged under its own weight. This allows the precise control of the discharge rate of the chalk in the chalk hopper 200 to create chalk lines. The first chalk line pattern 234 and second chalk line pattern 240 creates a defined and clearly visible chalk line.

Figure 26:
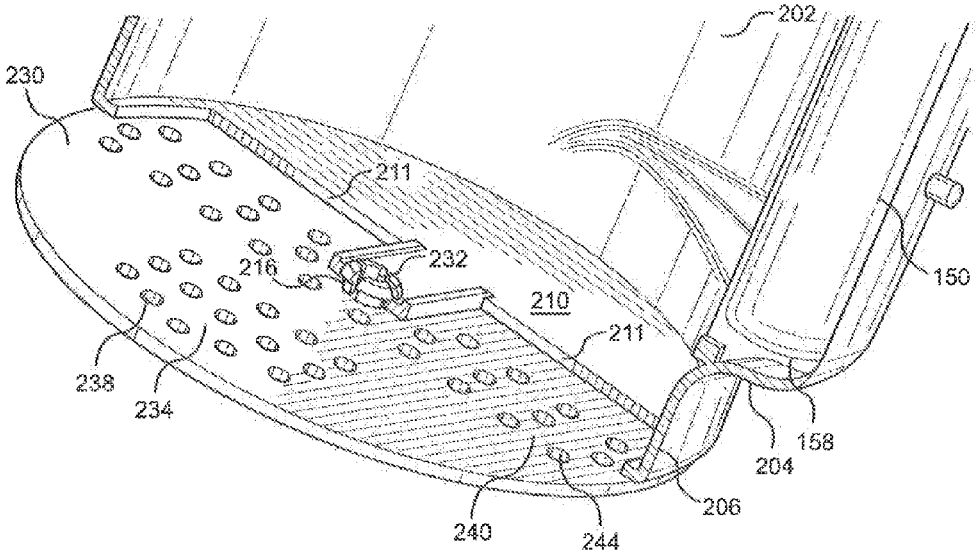
FIG. 26 is a sectional view of the alternative embodiment of the Handheld All-Terrain Chalker of the present invention showing the adjustable chalk line plate removably attached to the chalk hopper and configured to dispense a chalk line having the second chalk line pattern.

Referring now to FIG. 26 a cutaway view of the Handheld All-Terrain Chalker 20 is shown. As shown, the adjustable chalk line plate 230 is attached to the dispenser plate 210 of the chalk hopper 200 by inserting the quick-release fastener 232 into the mounting point 216 of the dispenser plate 210. The adjustable chalk plate 230 covers the dispenser opening 211 of the dispenser plate 210 and serves as a regulator to regulate the amount of chalk dispensed. The width 222 of the dispenser opening 211 of the dispenser plate 210 is wide enough to accommodate the width 236 of the first pattern 234 and the width 242 of the second pattern 240.

Figure 28:
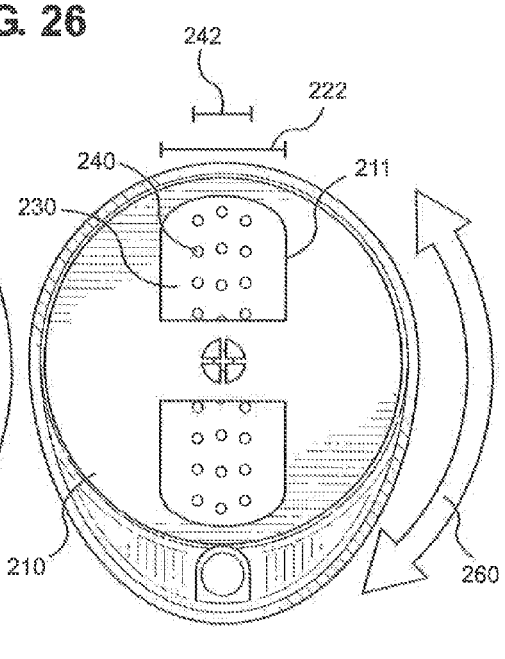
FIG. 28 is a top view of the Handheld All-Terrain Chalker with adjustable chalk line plate rotated to align the second chalk line pattern with the opening of the dispenser.

To adjust the width of a chalk line the user rotates the adjustable chalk line plate 230 in direction 260. As shown in FIG. 26 and FIG. 28, the adjustable chalk line plate 230 is rotated to a position where the second chalk line pattern 240 is exposed to the dispenser opening 211 of the dispenser plate 210. This allows the chalk held within the chalk hopper to be dispensed through the first chalk line pattern 240 holes 244 of the adjustable chalk line plate 230. This results in a chalk line with the width 242 of the second chalk pattern 240.

Figure 27:
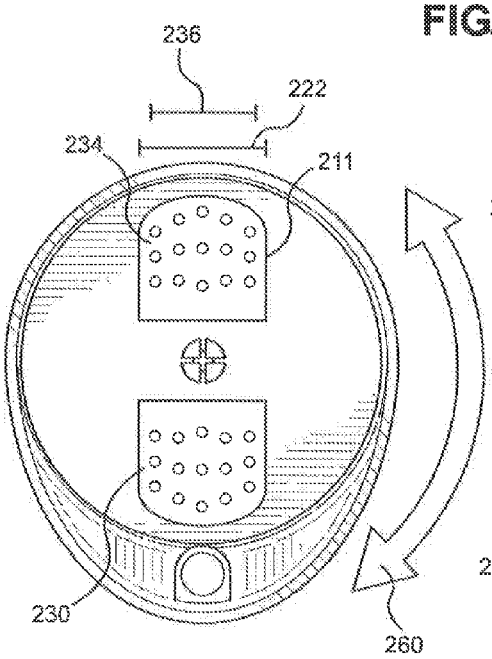
FIG. 27 is a top view of the Handheld All-Terrain Chalker with adjustable chalk line plate rotated to align the first chalk line pattern with the opening of the dispenser.

FIG. 27 shows the adjustable chalk line plate 230 rotated in direction 260 to position to the first chalk line pattern 234 in alignment with the dispenser opening 211. This results in a chalk line with the width 236 of the first chalk pattern 234. The Handheld All-Terrain Chalker 20 dispense chalk utilizing the same method as used to dispense chalk using the Handheld All-Terrain Chalker 10, specifically by tapping the Handheld All-Terrain Chalker 20 against a surface or pulsating the Handheld All-Terrain Chalker 20 up and down above the surface.

While the Handheld All-Terrain Chalker of the present invention as herein shown and disclosed in detail is fully capable of obtaining the objects and providing the advantages herein before stated, it is to be understood that it is merely illustrative of the preferred and alternative embodiments of the invention and that no limitations are intended to the details of construction or design herein shown other than as described in the appended claims. In addition, while there have been shown what are presently considered to be preferred embodiments of the present invention, it will be apparent to those skilled in the art that various changes and modifications can be made herein without departing from the scope and spirit of the invention.

I claim:

1. A Handheld All-Terrain Chalker comprising:

a chalk hopper formed with a handle receiver;

an ergonomic handle removably inserted into said handle receiver;

a chalk line gasket inserted into said chalk hopper; and wherein said chalk hopper dispenses a chalk line having a width, said chalk line gasket controlling said width of said chalk line.

2. The Handheld All-Terrain Chalker of claim 1, wherein said chalk hopper is a semicircular bucket comprising:

a storage container;

a transition ledge;

a dispenser;

a chalk line plate; and wherein said storage container connects to the transition ledge and the dispenser, said chalk line plate connects to said dispenser forming said semicircular bucket.

3. The Handheld All-Terrain Chalker of claim 2, wherein said chalk line plate is formed with a chalk line pattern, said pattern comprising a series of holes arranged in a staggered pattern and confined within a perimeter of a rectangle having a chalk line width and a chalk line length.

4. The Handheld All-Terrain Chalker of claim wherein said chalk line plate is further formed with a plurality of sockets.

5. The Handheld All-Terrain Chalker of claim 4, wherein said plurality of sockets is formed into said chalk line plate on either side of said chalk line pattern.

6. The Handheld All-Terrain Chalker of claim 5, wherein said semi-circular bucket comprises:

an opening edge formed at an angle on said storage container;

a lip formed on said storage container adjacent said opening edge; and a handle retaining hole formed on said storage container and said handle receiver.

7. The Handheld All-Terrain Chalker of claim 6, wherein said chalk line gasket is a circular disk formed with a chalk line opening the center of said circular disk and a plurality of protrusions formed on either said of said chalk line opening.

8. The Handheld All-Terrain Chalker of claim 7, wherein said chalk line opening is formed with a chalk line gasket width and chalk line gasket length.

9. The Handheld All-Terrain Chalker of claim 8, wherein said protrusion is dimensioned to be received by said socket.

10. The Handheld All-Terrain Chalker of claim 9, wherein said transition ledge is formed at an angle.

11. The Handheld All-Terrain Chalker of claim 10, wherein said ergonomic handle comprises:

a metal tube having a first end formed with retaining clip holes and a second end;

a retaining clip having buttons retained in said retain clip holes formed wherein said buttons protrude through said retaining clip holes; and a handle grip attached to said second end of said metal tube.

12. The Handheld All-Terrain Chalker of claim 11, wherein said metal tube is formed with an S-shape, wherein said second end of said metal tube is perpendicular to said first end of said metal tube.

13. The Handheld All-Terrain Chalker of claim 12, wherein said second end of said metal tube terminates at an axial line projected through said first end of said metal tube, wherein said handle grip is positioned along a center of gravity of said Handheld All-Terrain Chalker.

14. A Handheld All-Terrain Chalker comprising:

a chalk hopper formed with a handle receiver;

an ergonomic handle removably inserted into said handle receiver;

an adjustable chalk line plate removably attached to said chalk hopper; and wherein said chalk hopper dispenses a chalk line having a width, said adjustable chalk line plate controlling said width of said chalk line.

15. The Handheld All-Terrain Chalker of claim 14, wherein said chalk hopper is a semi-circular bucket comprising:

a storage container;

a transition ledge;

a dispenser;

a dispenser plate; and wherein said storage container connects to the transition ledge and the dispenser, said dispenser plate connects to said dispenser forming said semi-circular bucket.

16. The Handheld All-Terrain Chalker of claim 15, wherein said dispenser plate is formed with a dispenser opening and adjustable chalk line plate mounting hole.

17. The Handheld All-Terrain Chalker of claim 16, wherein said adjustable chalk line plate is a circular disk comprising:

a first chalk line pattern formed in said disk;

a second chalk line pattern formed in said disk; and a removable fastener configured to be received by said adjustable chalk line plate mounting hole.

18. The Handheld All-Terrain Chalker of claim 17, wherein said first chalk line pattern comprises a series of holes arranged in a staggered pattern and confined within a perimeter of a rectangle having a first chalk line pattern width and a first chalk line pattern length.

19. The Handheld All-Terrain Chalker of claim 18, wherein said second chalk line pattern comprises a series of holes arranged in a staggered pattern and confined within a perimeter of a second rectangle having a second chalk line pattern width and a second chalk line pattern length, wherein said second chalk line pattern width is smaller than said first chalk line pattern width.

20. The Handheld All-Terrain Chalker of claim 19, wherein said removable fastener of said adjustable chalk line plate is inserted into said adjustable chalk line plate mounting hole of said dispenser plate forming a rotational axis, wherein said adjustable chalk line plate is rotatable along said rotational axis to align said first chalk line pattern or said second chalk line pattern with said dispenser opening.

* * * * *

UNITED STATES PATENT AND TRADEMARK OFFICE

CERTIFICATE OF CORRECTION

PATENT NO. : 9,340,063 B1
APPLICATION NO. : 14/537074
DATED : May 17, 2016
INVENTOR(S) : Jon Hale It is certified that error appears in the above-identified patent and that said Letters Patent is hereby corrected as shown below:

IN THE SPECIFICATION

Column 3, line 55, reading "angle (1)" should read --angle Φ--

Column 4, line 30, reading "number of holes 26" should read --number of holes 126--

Column 8, line 7, reading "A hp 212" should read --A lip 212--

IN THE CLAIMS

Column 11, line 10, the phrase reading "claim wherein" should read --claim 3 wherein--

Signed and Sealed this
Nineteenth Day of July, 2016

Michelle K. Lee

Michelle K. Lee
*Director of the United States Patent and Trademark Office*